United States Patent [19]

Smyth

[11] Patent Number: 4,532,666

[45] Date of Patent: Aug. 6, 1985

[54] BRUSH WITH DETERGENT FEED

[75] Inventor: Donald N. Smyth, South Plympton, Australia

[73] Assignee: Sabco Limited, Albert Park, Australia

[21] Appl. No.: 478,067

[22] Filed: Mar. 22, 1983

[51] Int. Cl.[3] ..... A46B 13/06

[52] U.S. Cl. ..... 15/22 R; 15/29; 137/897; 239/317

[58] Field of Search ..... 15/24, 29, 97 R, 22 R; 137/896, 897, 898; 239/310, 317

[56] References Cited

U.S. PATENT DOCUMENTS 1,604,500 10/1926 Tannenbaum ..... 15/29
1,691,523 11/1928 Maycen ..... 15/29

FOREIGN PATENT DOCUMENTS 1031993 3/1953 France ..... 15/29

*Primary Examiner*—Edward L. Roberts
*Attorney, Agent, or Firm*—Oldham, Oldham & Weber Co.

[57] ABSTRACT

A detergent dispenser for a brush having a rotatable impeller driven by a jet of water. The dispenser has a tank connected to a valve having a blade positioned to intercept the flow of water around the impeller, part of the water passing into the tank to be mixed with the detergent to be dispensed into the flow of water around the impeller prior to the jet of water driving the impeller.

3 Claims, 5 Drawing Figures

BRUSH WITH DETERGENT FEED

This invention relates to a brush with a detergent feed, more particularly to the type of brush described in our earlier U.S. Pat. No. 4,471,503 entitled "BRUSH".

BACKGROUND OF THE INVENTION

There is described in that specification a brush, the brush having a body, bristles on the brush attached to the body, the body carrying a freely rotatable impeller, an eccentric weight on the impeller, and means for directing a flow of fluid onto the impeller so that on rotation of the impeller the brush body and bristles vibrate due to the eccentric mass on the impeller.

In this way the brush which may be circular, rectangular or any other shape does not have the bristles of the brush rotating, but the brush body merely vibrates due to the rotation of the impeller with the eccentric mass so that the driving force by the water on the impeller does not have to overcome the frictional resistance of rotation of the brush, but merely causes the brush body and bristles to vibrate.

It has now been found that the use and effectiveness of the brush is enhanced by the provision of a detergent dispenser.

Other systems are known for similar products which utilize fluid injection from the main stream of water, either by displacement of the fluid being dispensed, or by inducing the flow due to the action of a venturi so that the liquid is then drawn into the water stream. The disadvantages of these systems is that fluid to be dispensed is in direct contact with the water flow, and any backflow situation caused by a sudden reduction in pressure in the water supply line, or by an obstruction in the dispensing nozzle may cause the detergent to flow back into the main supply.

It is an object of this invention to provide a detergent dispenser which will overcome the above problem and which can provide a regulated flow of detergent into the water stream.

BRIEF DESCRIPTION OF THE INVENTION

Thus according to the invention the flow of the high speed water around the periphery of the turbine body is utilized, a blade or other obstruction being provided to be brought into the high speed layer and in so doing forms two vortices, the pressure differential created between the vortices causes some of the water to flow into the detergent container or compartment which is then readmitted into the high speed fluid flow just ahead of the incoming driving jet.

The action of the jet creates great turbulence and foam is thus generated, the dispenser being largely self regulating because the flow through the container is effected by the detergent viscosity, as the mix becomes weaker it becomes thinner and thus more is administered to the water flow.

DESCRIPTION OF THE PREFERRED EMBODIMENT

Figure 1:
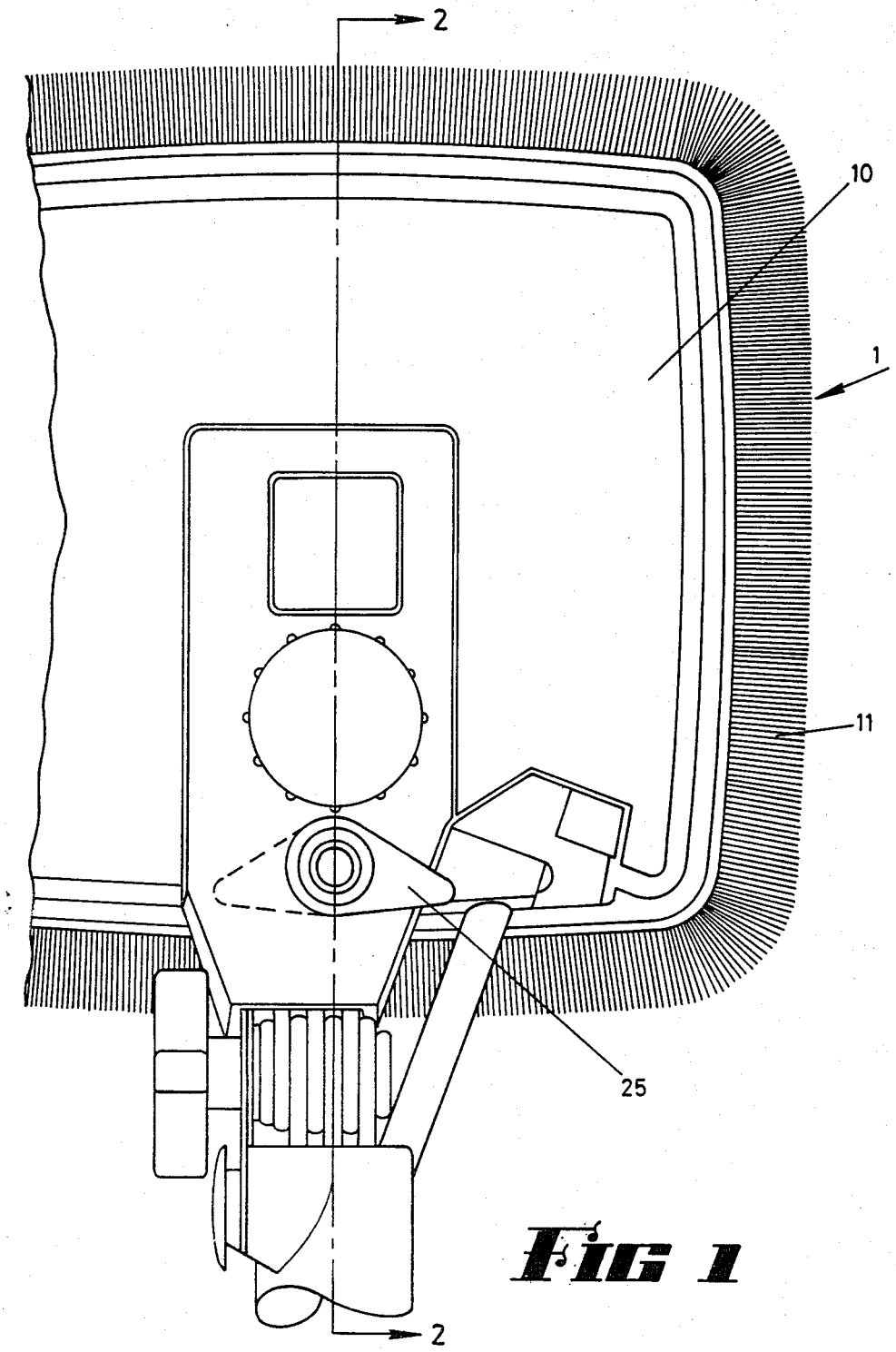
FIG. 1 is a plan view of the brush.
Figure 2:
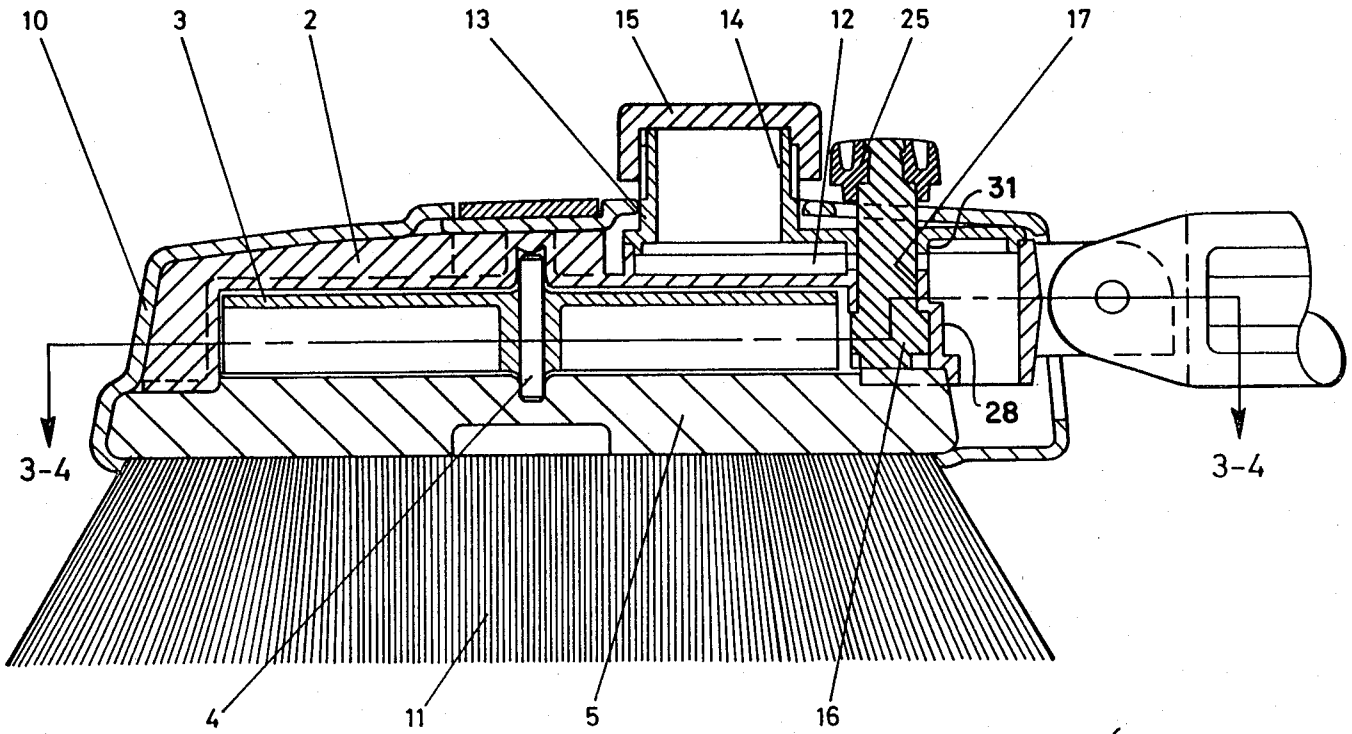
FIG. 2 is a section along the lines 2—2 of FIG. 1.
Figure 3:
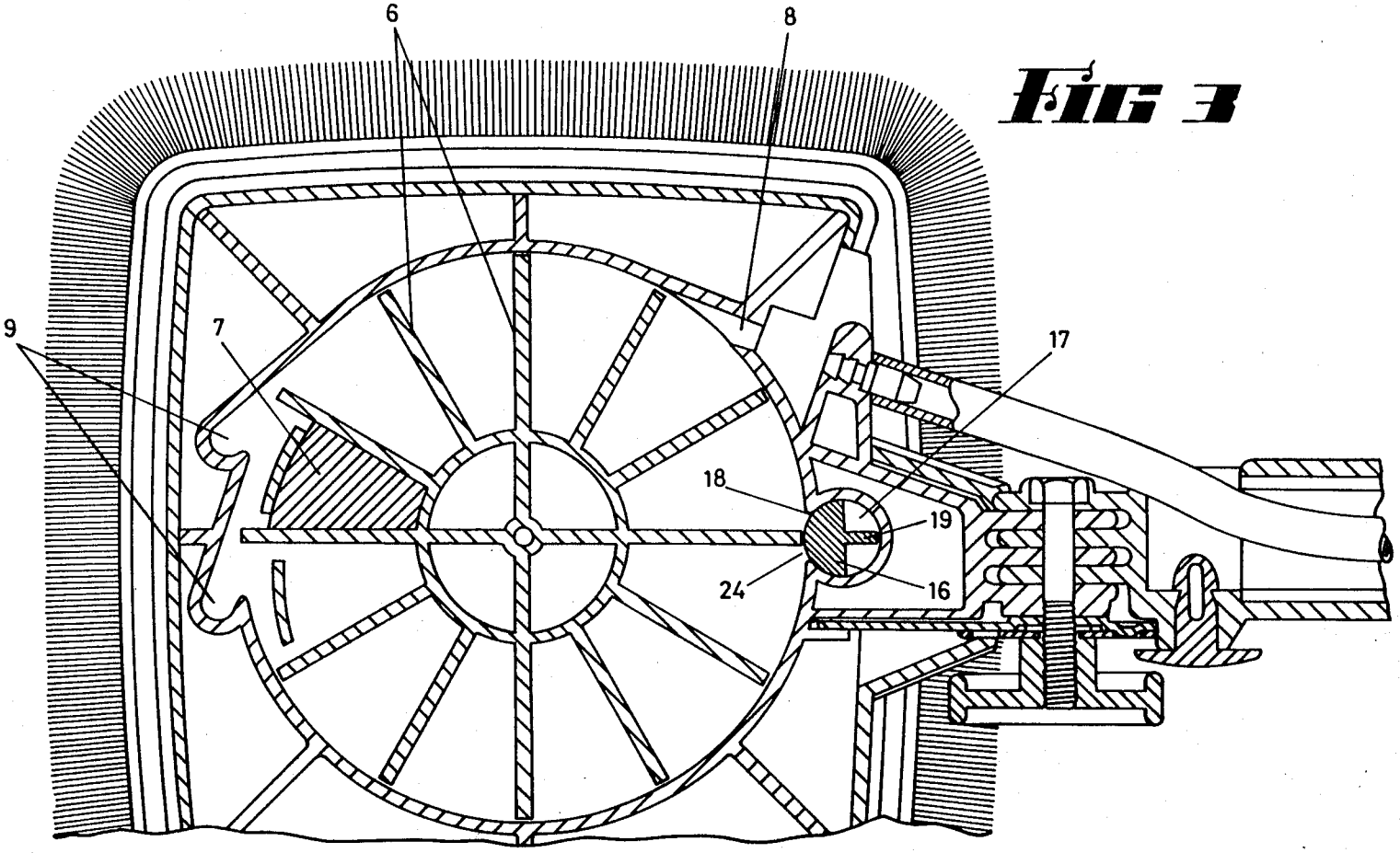
FIG. 3 is a section along the line 3—3 of FIG. 2 with the valve in the closed position.

The brush 1 has a brush body 2 carrying a rotatable impeller 3 rotatable on a bearing pin 4 mounted on the brush body 2 and a brush board 5. The impeller 3 has a plurality of vanes 6, and between a pair of vanes 6 is a weighted member 7 which thus is eccentrically placed so that on rotation of the impeller a vibratory motion is imparted to the brush. The impeller 3 is driven by water from a jet nozzle 8, the water exhausting through exhaust passages 9 through the brush board 5 as described in our earlier U.S. Pat. No. 4,471,503. An outer cover 10 covers the brush body, with the brush board 5 carrying bristles 11.

In a preferred form of the invention the brush body 2 is provided with a detergent tank 12 having a body 13 and an extension 14 closed by cap 15 for the detergent container. Also the brush body 2 contains a rotary valve member 16 inserted in a bore 17 formed in member 28 on body 2, and extension 31 on tank body 13, opening into the tank 12, this bore also having an aperture 18 opening into the impeller area.

The rotary valve member 16 is rotatable in the bore 17, the valve member having a blade 19 which is adapted to protrude slightly through the aperture 18 opening into the impeller area to thus intercept the portion of the high speed fluid passing around the impeller housing.

The valve member is provided with axial passages 20,21 connecting to cut out portions 22,23 one on each side of the blade member 19 to thus interconnect both sides of the blade member to the fluid compartment at circumferentially spaced locations.

Figure 4:
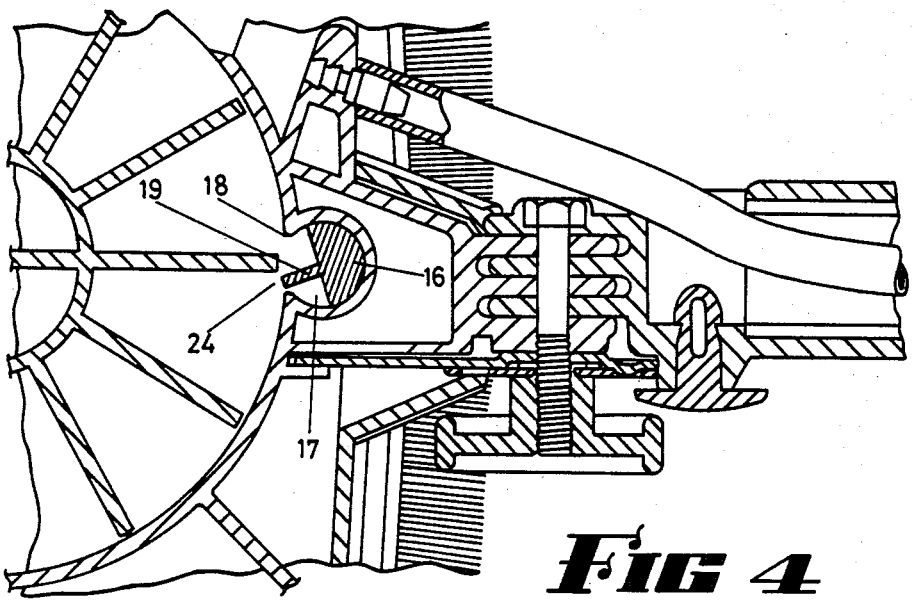
FIG. 4 is a partial view similar to FIG. 3 with the valve in the open position.
Figure 5:
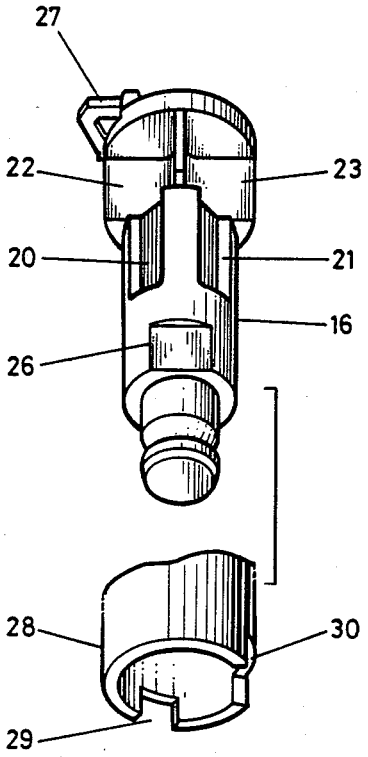
FIG. 5 is a view of the valve element.

When the blade member is positioned to intercept the fluid flow as shown in FIG. 4 the two vortices are caused one on each side of the blade member, one forcing the water past the blade and up the axial passage 20 into the detergent tank 12, where it is then mixed with the detergent in the fluid compartment and/or in the container attached thereto, the mixture then passing back downwardly via the other axial passage 21 where it is drawn by the pressure of the second vortex to be mixed within the jet issuing to drive the turbine.

The valve member can be rotated to move the blade member out of position and in the closed position the portion 24 of the valve member 16 closes off the aperture opening into the turbine area.

Thus it will be seen that by positioning the valve to dispense the detergent into the turbine area upstream of the jet driving the turbine, that the jet itself does not pressurize the detergent compartment of the container, and as the dispenser will only operate when water is being forced into it due to for rotation of the turbine that any possibility of backflow is eliminated.

The dispensing regulation of the fluid flow is determined mainly by the detergent viscosity, and as the detergent becomes mixed with more water, it becomes thinner and thus more is administered to thus generally maintain the desired detergent flow rate.

The valve 16 is provided with a knob 25 engageable on portion 26 so that it can be rotated from the closed to the open position, a stop 27 on the bottom of the valve member 16 engaging in recesses in the brush body 2 to limit the degree of rotation in each direction.

The member 28 forming the lower portion of the bore 17 has notches 29 and 30 corresponding in position to the passages 20, 21 when the valve is in the on position so that the water enters the tank 12 at a circumferentially spaced location from the outlet from the valve for mixing of the water with the detergent.

Although the invention has been described in some detail as applied to a brush as detailed in the our earlier Patent referred to above, it is to be realised that the invention can be applied to other forms of rotatable cleaning members and rotatable brushes where there is a flow of high speed fluid such as water passing around a surface with the rotatable valve being adapted to be positioned adjacent that surface.

I claim:

1. Means for adding a supply of detergent to a flow of fluid over a surface of a housing, characterised in that said means comprises a detergent tank supported by said housing and situated adjacent said surface, a bore in said housing parallel to said surface and opening into said surface, a rotatable valve element in said bore and having a blade adapted to be positioned in said opening, said valve element having axial passages connecting to each side of said blade, whereby said blade element interrupts said flow to form a vortice on each side of said blade which causes fluid to flow up one axial passage into said tank to be mixed with said detergent and be dispensed down said other axial passage into the fluid flow over the surface.

2. Means as defined in claim 1 wherein said means is attached to a brush having bristles whose brushing action is activiated by a jet of water driving a rotatable impeller, said impeller being mounted in the housing forming said surface, said surface being cylindrical with said jet being generally tangential to said surface so that the water flows around said cylindrical surface, said bore and rotatable valve element opening into said surface downstream of said jet of water, whereby said mixture of detergent and water passes to and is further mixed by said jet, and means to dispense said mixture of detergent and water to the bristles of the brush.

3. Means as defined in claim 2 characterised in that said bore has an upstanding portion, and cut outs on the upstanding portion corresponding in position to the axial passages on the valve member to form fluid flow apertures spaced circumferentially around the valve to cause mixing of the fluid and the detergent in the tank.

* * * * *